US005622488A

United States Patent [19]

Tojo et al.

[11] Patent Number: 5,622,488

[45] Date of Patent: Apr. 22, 1997

[54] SCROLL TYPE FLUID MACHINE HAVING FIRST AND SECOND FRAME MEMBERS TO INCREASE AIR TIGHTNESS

[75] Inventors: Kenji Tojo; Hideyuki Ueda; Takao Mizuno; Takeshi Hida, all of Shimizu, Japan

[73] Assignee: Hitachi, Ltd., Tokyo, Japan

[21] Appl. No.: 515,333

[22] Filed: Aug. 15, 1995

[30] Foreign Application Priority Data

Sep. 20, 1994 [JP] Japan ..... 6-224766

[51] Int. Cl.[6] ..... F01C 1/04

[52] U.S. Cl. ..... 418/55.5; 418/57

[58] Field of Search ..... 418/55.5, 57

[56] References Cited

U.S. PATENT DOCUMENTS 5,277,563 1/1994 Wen-Jen et al. ..... 418/55.5
5,340,287 8/1994 Kawamura et al. ..... 418/55.5
5,342,186 8/1994 Swain ..... 418/55.5

FOREIGN PATENT DOCUMENTS 63-80088 4/1988 Japan .

*Primary Examiner*—Charles G. Freay
*Attorney, Agent, or Firm*—Antonelli, Terry, Stout & Kraus, LLP

[57] ABSTRACT

A scroll type compressor having high efficiency and high reliability is obtained by preventing leakage of a compression chamber, increasing air tightness thereof and securing a smooth motion of an orbiting scroll member. A second frame member supported by a first frame member and slightly movable in the axial direction is disposed in the rear of an orbiting scroll member. Force is applied to the rear of the second frame member, and a slight axial movement of the orbiting scroll member is regulated by a fixed scroll member and the second frame member. As a result, both the scroll members are in tight contact or close to each other with a small space, and a smooth movement thereof can be secured, which makes it possible to obtain a scroll type compressor having high efficiency and high reliability.

5 Claims, 5 Drawing Sheets

SCROLL TYPE FLUID MACHINE HAVING FIRST AND SECOND FRAME MEMBERS TO INCREASE AIR TIGHTNESS

BACKGROUND OF THE INVENTION

1. Field of the Invention

The present invention relates to a scroll type fluid machine, and more particularly, to a scroll type compressor suitably used as a refrigerant compressor of an air conditioner and a refrigerator, and as an air compressor.

2. Description of the Related Art

In a conventional scroll type compressor, a fixed scroll member and an orbiting scroll member, each composed of an end plate and a scroll wrap portion standing perpendicular to the end plate, are meshed with the wrap portions inside and the orbiting scroll member is driven by a main shaft directly connected to a motor or the like to make revolution, by which refrigerant gas is sucked into a compression chamber formed by both the scroll members, the compression chamber is moved to a central portion to reduce the volume thereof and increase the pressure therein, and the refrigerant gas is exhausted from a discharge port in the central portion therein.

In such a scroll type compressor, compression is performed by meshing both the scroll wrap portions with each other, and setting of the positions of these wrap portions in the vertical direction is considerably important. If wider spaces than needed are formed between the leading ends of the wrap portions and the opposed end plates, the refrigerant gas leaks from the spaces to the low pressure side, thereby lowering the performance of the compressor. Furthermore, if the leading ends of the wrap portions are in excessively strong contact with the corresponding end plates, galling and wear are caused and interfere with smooth compression.

Still further, since the gas in the compression chamber has a force which separates the scroll members from each other in the axial direction, there is provided a mechanism for keeping, against this separating force, both the scroll members in tight contact or slightly spaced.

For example, Japanese Patent Unexamined Publication No. 63-80088 discloses a closed scroll type compressor which increases the pressure of a refrigerant gas, led into a hermetic case, by compression and directly discharges the refrigerant gas to the outside of the hermetic case. In this compressor, a thrust bearing is provided in the rear of an end plate in an orbiting scroll member, a fixed scroll member is fixed to the hermetic case through a pair of leaf springs, and an airtight chamber is formed in the rear of the fixed scroll member. Gas pressure is applied to the airtight chamber to slightly move the fixed scroll member in the axial direction thereof, and to minimize the space between wrap portions of the scroll members, by which leakage of a compression chamber can be prevented.

However, in such a structure, the whole thrust force in the axial direction applied to the orbiting scroll member by compressing the refrigerant gas acts on the thrust bearing. Furthermore, when the fixed scroll member is slightly moved toward the orbiting scroll member against the spring force of the leaf springs by exerting the gas pressure on the rear of the fixed scroll member, a force, which is obtained from deducting a reaction force of the leaf springs from the gas pressure applied to the rear of the fixed scroll member, further presses the orbiting scroll member in the axial direction, and therefore, the thrust bearing receives greater force.

Accordingly, an expensive thrust bearing resistant to a heavy thrust load is needed, and frictional force is caused by the slide between the thrust bearing and the rear of the end plate in the orbiting scroll member, which results into large sliding loss, lowered efficiency of the compressor, and abrasion, burning and the like of the aforesaid sliding portion.

Further, in such a structure, a complicated structure is required to move the fixed scroll member in the axial direction, to avoid excessive contact and abutment between the wrap portions of the fixed scroll member and the orbiting scroll member, and to prevent the displacement of center shafts and phases of both the scroll wrap portions. This causes various problems, for example, decrease in productivity and decrease in efficiency and reliability owing to excessive contact.

SUMMARY OF THE INVENTION

An object of the present invention is to provide a scroll type compressor which reduces leakage of a compression chamber defined by an orbiting scroll member and a fixed scroll member by improving air tightness of the compression chamber.

In order to achieve the above object, there is provided a scroll type fluid machine comprising a fixed scroll member and an orbiting scroll member each having an end plate and a scroll wrap portion standing perpendicular to the end plate, wherein the orbiting scroll member is connected to a driver with a main shaft, gas is discharged from a discharge port, and these components are housed in a hermetic case, the scroll type fluid machine further comprising a first frame member positioned on the opposite side of the orbiting scroll member to the wrap portion side thereof, rotatably supporting the main shaft and fixed to the hermetic case, and a second frame member provided between the first frame member and the orbiting scroll member to receive a gas pressure for pressing the orbiting scroll member toward the fixed scroll member.

The function of the present invention having the above-mentioned structure is as follows.

The second frame member supported by the first frame member and capable of moving slightly in the axial direction is located on the opposed side of the orbiting scroll member to the wrap portion side thereof, and the second frame member and the fixed scroll member restrict the axial slight movement of the orbiting scroll member. When pressure is applied to an airtight space formed in the rear of the second frame member, the second frame member slightly moves toward the orbiting scroll member and slides on the rear surface of the orbiting scroll member, thereby restricting the axial movement of the orbiting scroll member. The orbiting scroll member is in tight contact with or close with a slight space to the fixed scroll member to thereby avoid leakage of the compression chamber defined by the orbiting scroll member and the fixed scroll member. Therefore, it is possible to obtain a scroll type compressor having high efficiency and high reliability.

DESCRIPTION OF PREFERRED EMBODIMENTS

Figure 1:
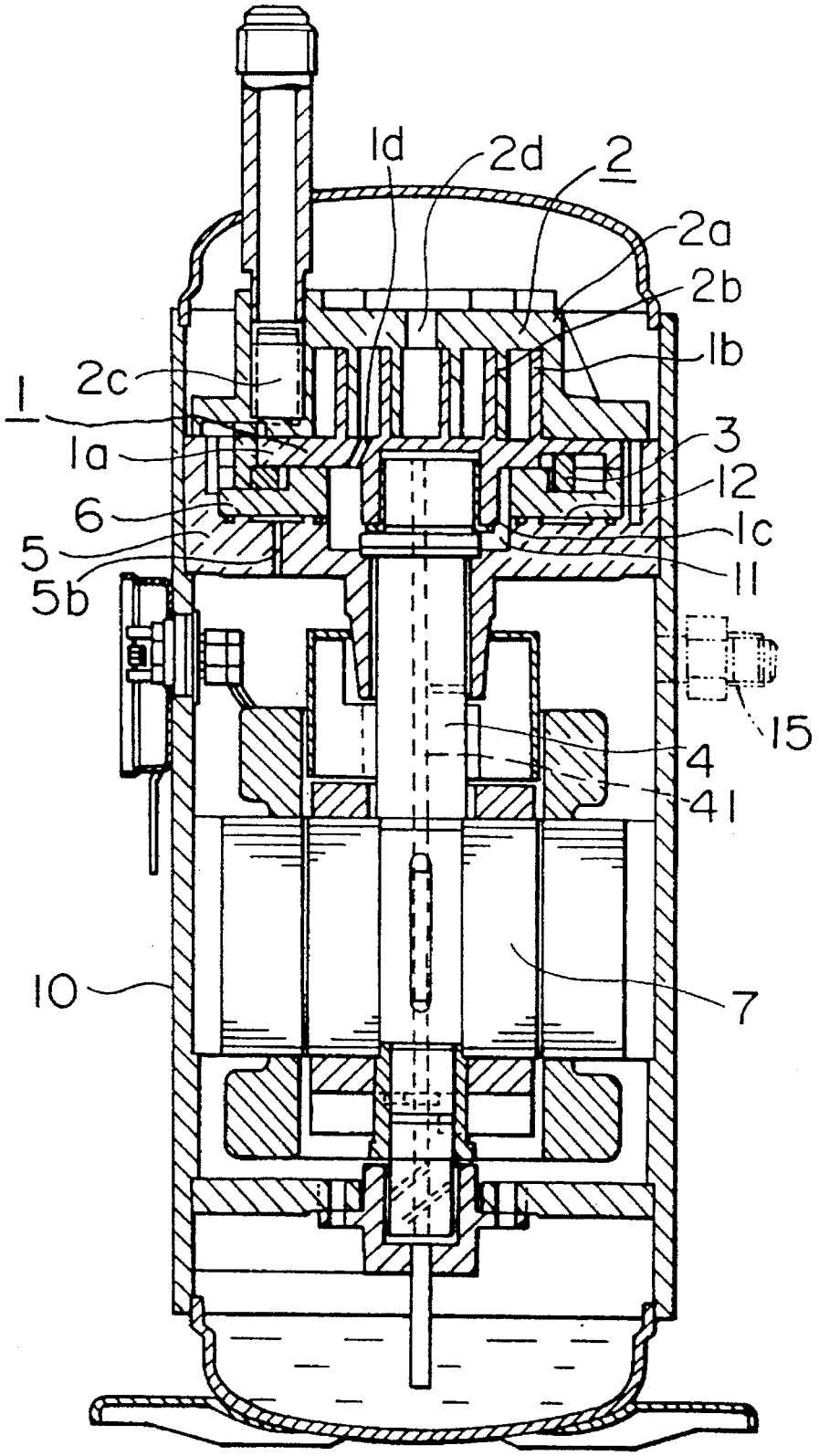
FIG. 1 is a longitudinal cross sectional view of a closed scroll type compressor according to an embodiment of the present invention.
Figure 2A:
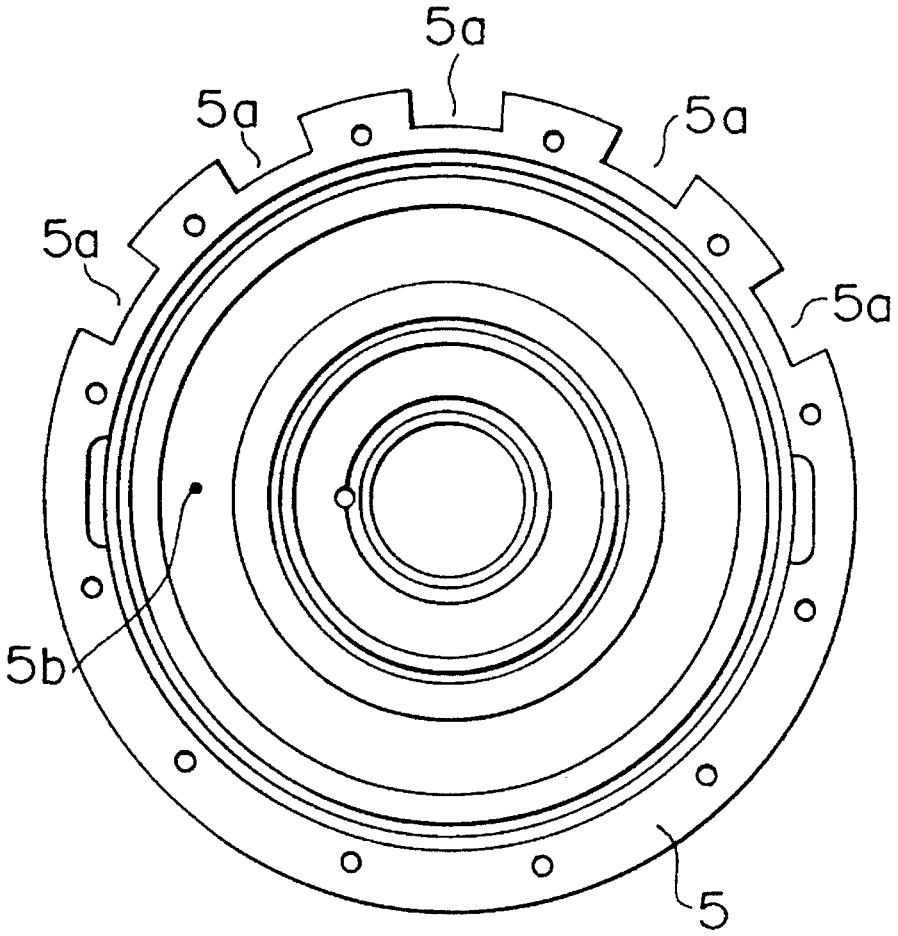
FIGS. 2A and 2B show a first frame member, FIG. 2A being a plan view and FIG. 2B a longitudinal cross sectional view.
Figure 2B:
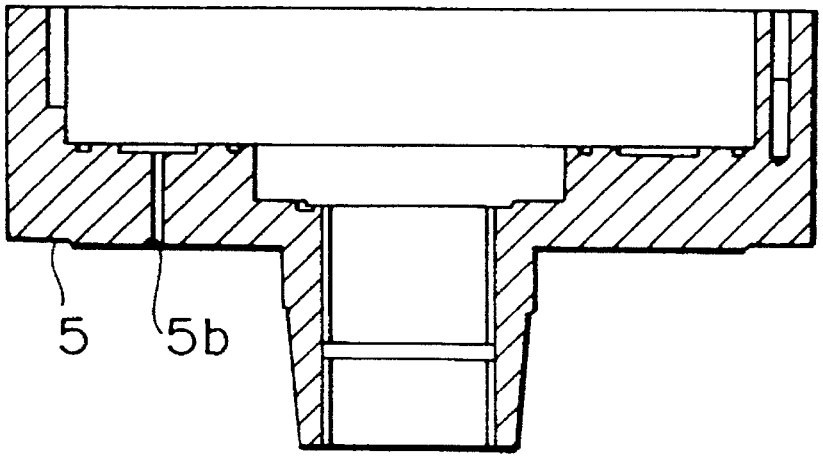
Figure 3A:
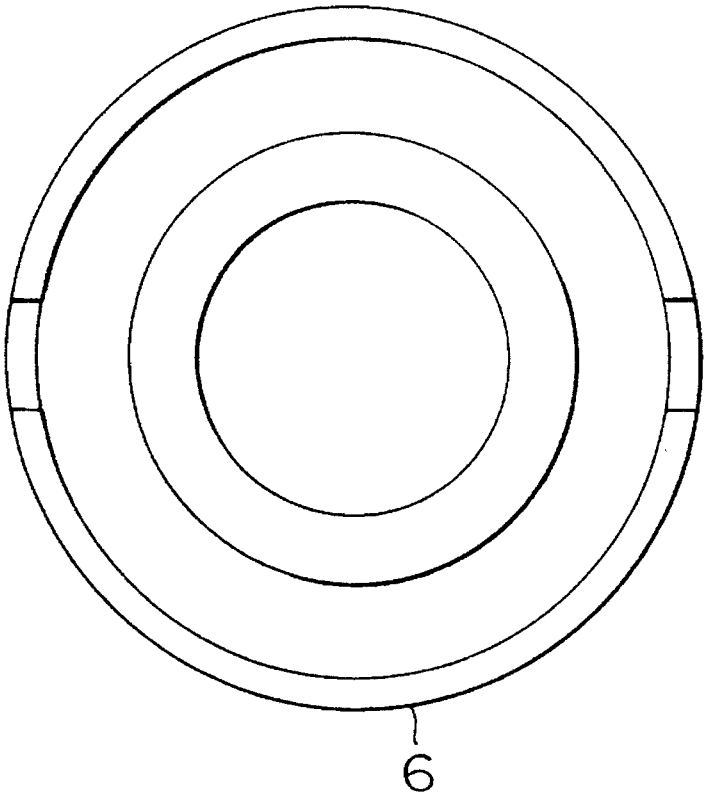
FIGS. 3A and 3B show a second frame member, FIG. 3A being a plan view, and FIG. 3B a longitudinal cross sectional view.
Figure 3B:
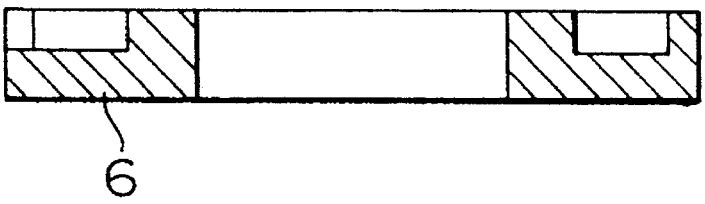
Figure 4:
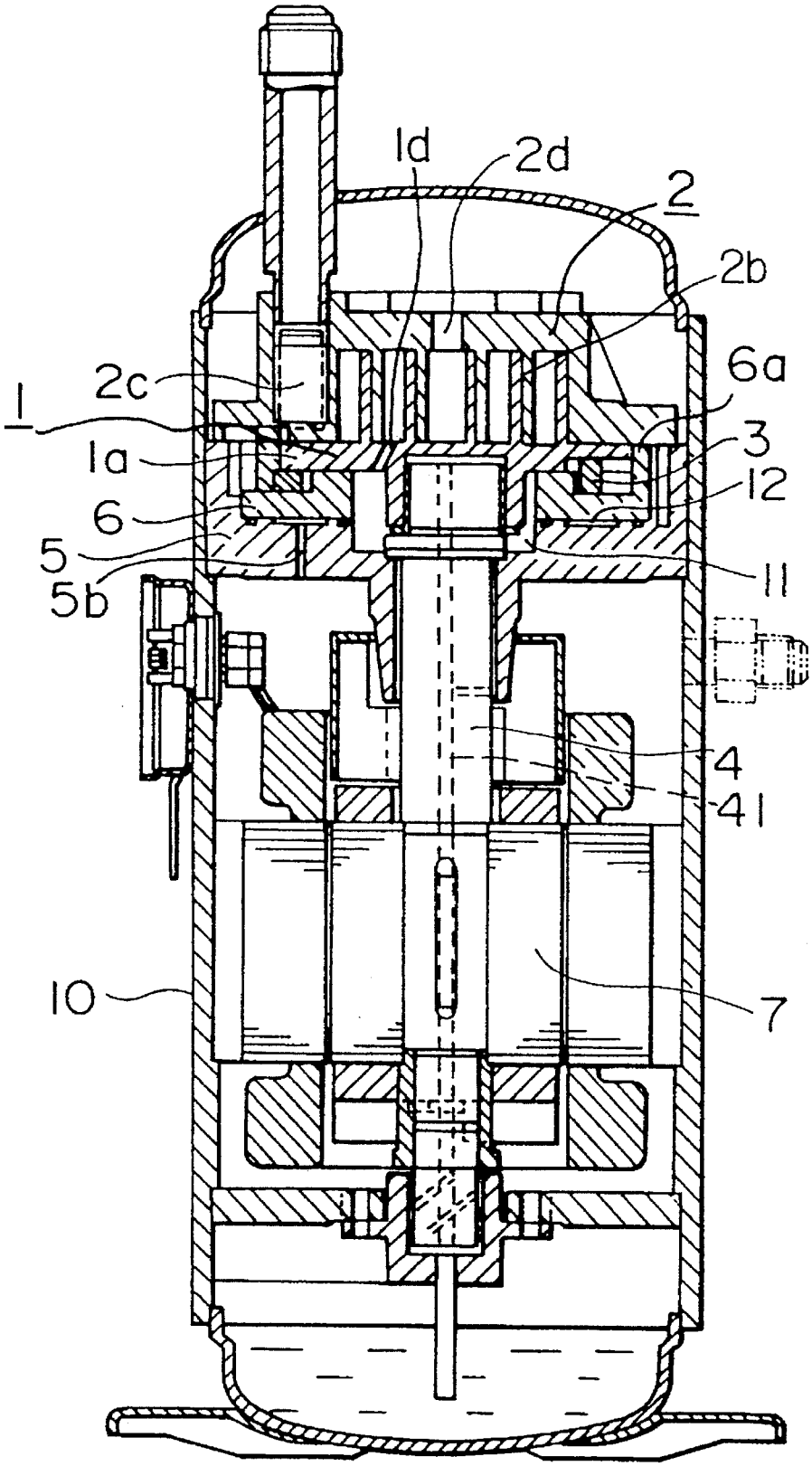
FIG. 4 is a longitudinal cross sectional view of a closed scroll type compressor according to another embodiment of the present invention.
Figure 5A:
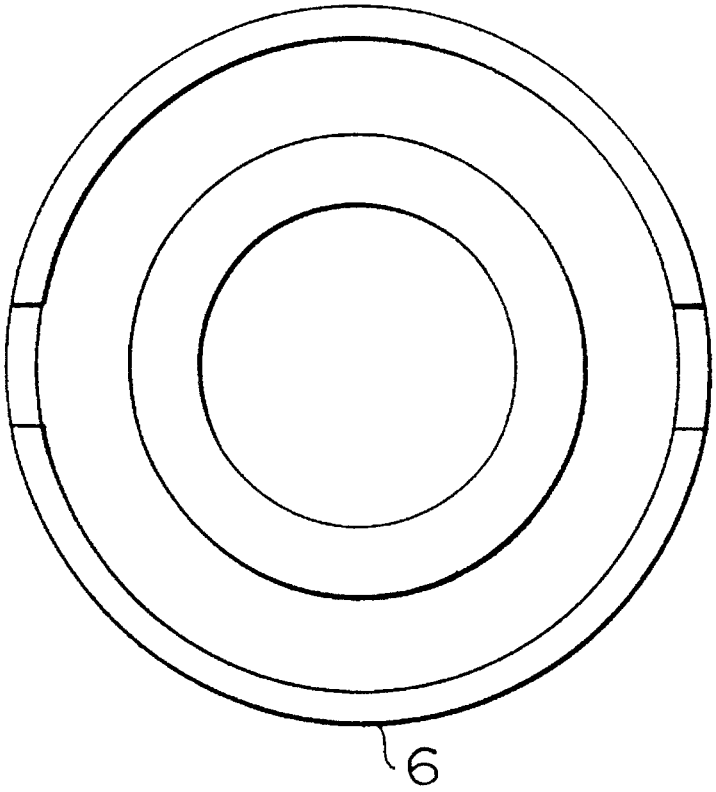
FIGS. 5A and 5B show a second frame member according to another embodiment of the present invention, FIG. 5A being a plan view and FIG. 5B a longitudinal cross sectional view.
Figure 5B:
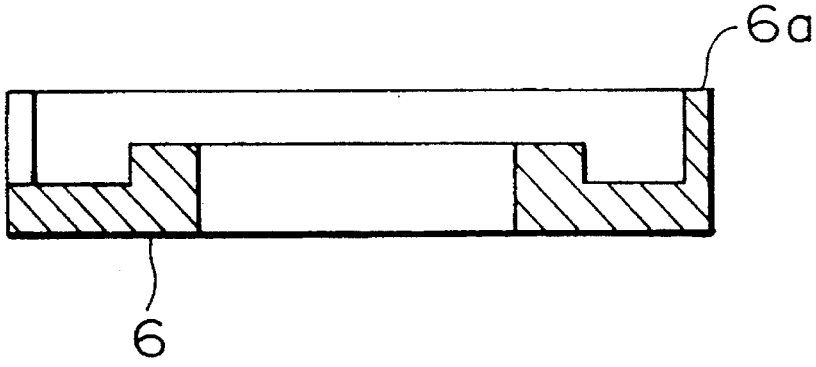

The preferred embodiments of the present invention will be described below with reference to FIGS. 1 to 5. FIG. 1 is a longitudinal cross sectional view of a closed scroll type compressor according to an embodiment of the present invention, FIGS. 2A and 2B are respectively plan and longitudinal cross sectional views of a first frame member shown in FIG. 1, FIGS. 3A and 3B are respectively plan and longitudinal cross sectional views of a second frame member shown in FIG. 1, FIG. 4 is a longitudinal cross sectional view of a closed scroll type compressor according to another embodiment of the present invention, and FIGS. 5A and 5B are respectively plan and longitudinal cross sectional views of a second frame member shown in FIG. 4.

As shown in FIG. 1, a hermetic case 10 accommodates a compression mechanism section and a motor section. Although a motor is used as a driver in this embodiment, other driver may be used instead of the motor. The compression mechanism section includes an orbiting scroll member 1, a fixed scroll member 2, a rotation preventing member 3, a main shaft 4 for driving the orbiting scroll member 1, a first frame member 5 for supporting these components, and the like. The fixed scroll member 2 is composed of an end plate 2*a* and a wrap portion 2*b* standing perpendicular to the end plate 2*a*. The fixed scroll member 2 further includes an intake port 2*c* and a discharge port 2*d*. The orbiting scroll member 1 comprises a disc end plate 1*a*, a wrap portion 1*b* standing perpendicular to the end plate 1*a*, and a concave boss 1*c* formed on the surface opposed to the wrap portion 1*b* (rear surface). The wrap portions 1*b* and 2*b* of the scroll members 1 and 2 each have the shape of an involute curve or a similar curve. The fixed scroll member 2 and the orbiting scroll member 1 are meshed with each other so that the wrap portions 1*b* and 2*b* thereof are opposed to each other.

The first frame member 5 rotatably supports the main shaft 4, connected to a motor 7 at one end thereof, through a bearing portion provided in the center thereof. The outer peripheral surface of the first frame member 5 is joined to the inner wall of the hermetic case 10. The main shaft 4 rotatably supported by the bearing portion of the first frame member 5 is connected to the motor 7 at one end, and an eccentric portion thereof is engaged with the boss 1*c* of the orbiting scroll member 1. An oil feed hole 41 is formed inside the main shaft 4 from the end of the eccentric portion throughout the length of the main shaft 4 to feed oil collecting in the hermetic case 10 to the aforesaid engaging portion.

An airtight chamber (orbiting scroll rear chamber 11) is formed on the surface of the orbiting scroll member 1 opposite to the wrap portion (rear surface) by the end plate 1*a* of the orbiting scroll member 1 and the first frame member 5. The orbiting scroll rear chamber 11 and a compression chamber formed by the scroll members 1 and 2, in which compression is being performed, communicate with each other through a communicating hole 1*d* formed through the end plate 1*a* of the orbiting scroll member 1.

In the rear of the orbiting scroll member 1, the rotation preventing member (Oldham's ring) 3 is provided to prevent rotation of the orbiting scroll member 1 on its axis.

Furthermore, a second frame member 6 supported by the first frame member 5 and capable of slightly moving in the axial direction is disposed in the rear of the orbiting scroll member 1. The axial movement of the orbiting scroll member 1 in the wrap direction (vertically upward) is regulated by the fixed scroll member 2, and the movement thereof in the rear direction (vertically downward) is regulated by the second frame member 6.

In the scroll type compressor having such a structure, the orbiting scroll member 1 is revolved relative to the fixed scroll member 2 by the action of the main shaft 4 and the rotation preventing member 3 in correlation to the rotation of the motor 7. As the compression chamber defined by the orbiting and fixed scroll members 1 and 2 moves toward those central portion, the volume thereof decreases, by which a refrigerant gas sucked from the intake port 2*c* into the compression chamber is compressed and discharged from the discharge port 2*d* into the upper portion of the hermetic case 10. The refrigerant gas discharged into the upper portion of the hermetic case 10 is passed through paths 5*a* formed on the outer periphery of the first frame 5 shown in FIG. 2A, sent to the lower portion of the hermetic case 10, and discharged to the outside through a discharge pipe 15.

Lubricating oil is stored at the bottom of the hermetic case 10 and sent to the engaging portion between the main shaft 4 and the bearing portion of the first frame member 5 and the engaging portion between the main shaft 4 and the boss 1*c* of the orbiting scroll member 1 through the oil feed hole 41 formed inside the main shaft 4, thereby lubricating the engaging portions. The lubricating oil led to the engaging portions is discharged into the orbiting scroll rear chamber 11 and the hermetic case 10. The lubricating oil discharged into the orbiting scroll rear chamber 11 is used to lubricate the sliding portion between the second frame member 6 and the orbiting scroll member 1 or the rotation preventing member 3, or led from the communicating hole 1*d* formed in the orbiting scroll member 1 or from the outer periphery of the orbiting scroll member 1 into the compression chamber defined by both the scroll members 1 and 2 to be used to seal the sliding portion of both the scroll members 1 and 2 or the compression chamber. After the completion of compression, the lubricating oil is discharged from the discharge port 2*d* into the hermetic case 10 together with the refrigerant gas and stored at the bottom of the hermetic case 10.

Since the airtight chamber (orbiting scroll rear chamber) 11 provided in the rear of the orbiting scroll member 1 communicates with the compression chamber defined by the scroll members 1 and 2, in which compression is being performed, through the communicating hole 1*d*, the pressure in the orbiting scroll rear chamber 11 is kept between an intake pressure and a discharge pressure.

On the other hand, a pressure almost equal to the discharge pressure or between the intake pressure and the discharge pressure is led to an airtight chamber (second frame rear chamber) 12 supported by the first frame member 5 and formed in the rear of the second frame member 6 movable in the axial direction (the discharge pressure is applied through an intake hole 5*b* in this embodiment), and kept at least higher than the pressure in the orbiting scroll rear chamber 11.

As a result, the second frame member 6 moves in the axial direction and slides in contact with the rear surface of the orbiting scroll end plate 1*a*, thereby pressing the orbiting scroll member 1 against the fixed scroll member 2 and restricting the axial movement of the orbiting scroll member 1.

An axial force acting on the rear surface of the orbiting scroll member 1 is the sum of the force of the second frame member 6, the pressure of the lubricating oil, almost equal to the discharge pressure, acting on the inside of the boss 1*c* in the orbiting scroll member 1, and the pressure in the orbiting scroll rear chamber 11.

On the other hand, an axial force resulting from the pressure in the compression chamber defined by both the scroll members 1 and 2 is exerted on the orbiting scroll member 1 in a direction for separating the scroll members 1 and 2.

Therefore, a force which overcomes the force acting vertically downward resulting from the pressure in the compression chamber is applied to the rear surface of the orbiting scroll member 1, the orbiting scroll member 1 is slightly moved in the axial direction, and put into tight contact with the fixed scroll member 2. The pressure in the orbiting scroll rear chamber 11 is determined as desired by the pressure receiving area of the orbiting scroll end plate 1*a* in the orbiting scroll rear chamber 11 and the position of the communicating hole 1*d* communicating with the compression chamber in the middle of compression. The force acting on the rear surface of the second frame member 6 can be also set at a desired value by changing the pressure receiving area of the second frame member 2 occupied in the second frame rear chamber 12 or leading the discharge pressure or the pressure in the compression chamber in the middle of compression.

As a result, it is possible to secure a smooth movement of the orbiting scroll member 1, to keep air tightness of the compression chamber defined by the orbiting scroll member 1 and the fixed scroll member 2, and to maintain high efficiency.

Another embodiment is shown in FIGS. 4 and 5. In the embodiment shown in FIG. 4, slight axial movement of a second frame member 6 supported by a first frame member 5 is regulated by a seat portion 6*a* (shown in FIGS. 5A and 5B) of the second frame member 6 and a bearer surface of the fixed scroll member 2 in contact with the seat portion 6*a*. Specifically, the second frame member 6 is moved toward the scroll members 1 and 2 (vertically upward) by the pressure applied to a second frame rear chamber 12, and stopped at the point at which the seat portion 6*a* abuts against the bearer surface of the fixed scroll member 2. As a result, the orbiting scroll member 1 is prevented from moving in the axial direction and sandwiched with a small space by the fixed scroll member 2 and the second frame member 6.

When the sum of the pressure acting on the orbiting scroll rear chamber 11 in the rear of the orbiting scroll member 1 and the pressure of lubricating oil, almost equal to the discharge pressure, acting on the inside of the boss 1*c* of the orbiting scroll member 1 is larger than the axial separating force resulting from the pressure in the compression chamber and acting on the wrap side of the orbiting scroll member 1, the orbiting scroll member 1 is pressed and put into tight contact with the fixed scroll member 2 to thereby make revolution. On the other hand, if the sum of the above axial forces is smaller than the separating force, the rear surface of the orbiting scroll member 1 slides on the second frame member 6 while keeping a slight space between the orbiting scroll member 1 and the fixed scroll member 2, which makes it possible to avoid excessive contact between the orbiting scroll member 1 and the fixed scroll member 2 and to obtain a scroll type compressor having high efficiency and high reliability.

Although the pressure in the hermetic case is equal to the discharge pressure and the pressure in the orbiting scroll rear chamber 11 is kept between the intake pressure and the discharge pressure in the above embodiments, the present invention is not limited to the structures shown in the embodiments. The present invention includes a case in which the pressure in the hermetic case is equal to the discharge pressure and the pressure in the orbiting scroll rear chamber is equal to the intake pressure. Similar function and advantageous effects can be also obtained in this case.

According to the present invention, when a slight axial movement of the second frame member is regulated by the seat portion thereof to be abutted against the fixed scroll member, the orbiting scroll member can move with a slight space relative to the fixed scroll member. Therefore, it is possible to avoid excessive contact between the orbiting scroll member 1 and the fixed scroll member 2 and to obtain a scroll type compressor having high efficiency and high reliability.

If the pressure in the compression chamber is extremely increased by mixture of a large amount of liquid refrigerant or oil therein and exceeds the pressure to be applied to the second frame member 2, the orbiting scroll member presses down the second frame member toward the rear of the orbiting scroll member (vertically downward), moves slightly in the rearward direction (vertically downward), and the space between the wrap portions of the fixed scroll member and the orbiting scroll member is increased to leak the gas, the liquid refrigerant or the oil from the high pressure side to the low pressure side, thereby avoiding excessive increase in pressure.

According to the present invention, it is possible to prevent leakage of the compression chamber defined by the orbiting scroll member and the fixed scroll member, and to obtain a scroll type compressor which is excellent in efficiency and reliability.

What is claimed is:

1. A scroll type fluid machine, comprising a fixed scroll member and an orbiting scroll member each having an end plate and a scroll wrap portion standing perpendicular to said end plate, wherein said orbiting scroll member is connected to a driver through a main shaft, and said above components are housed in a hermetic case, said scroll type fluid machine further comprising a first frame member positioned on the opposite side of said orbiting scroll member to the wrap portion side thereof, rotatably supporting said main shaft and fixed to said hermetic case, and a second frame member provided between said first frame member and said orbiting scroll member to be given a gas pressure for pressing said orbiting scroll member toward said fixed scroll member, and an orbiting scroll rear chamber provided as an airtight space, to which pressure in a compression chamber defined by said fixed scroll member and said orbiting scroll member in the middle of compression is led, on the inner periphery of said second frame member to press said orbiting scroll member toward said fixed scroll member.

2. A scroll type fluid machine according to claim 1, wherein said orbiting scroll member has a hole for communicating said orbiting scroll rear chamber and said compression chamber defined by said fixed scroll member and said orbiting scroll member during compression.

3. A scroll type fluid machine according to claim 2, further comprising a second frame rear chamber provided as an airtight space, to which discharge pressure is led, between said second frame member and said first frame member to press said second frame member toward said orbiting scroll member.

4. A scroll type fluid machine according to claim 3, wherein said first frame member has a hole for communicating said second frame rear chamber and a lower space of said hermetic case to be given discharge pressure.

5. A scroll type fluid machine according to claim 1, wherein a contact plane is provided between said fixed scroll member and said second frame member to regulate the amount of movement of said second frame member toward said orbiting scroll member.

* * * * *